United States Patent [19]

Nadeau

[11] Patent Number: 4,930,219

[45] Date of Patent: Jun. 5, 1990

[54] NOTCHING SCISSORS TO NOTCH AND TRIM CURVED SEAMS

[76] Inventor: Patricia B. Nadeau, 573 Loring Village Ct., Orange Park, Fla. 32073

[21] Appl. No.: 324,760

[22] Filed: Mar. 17, 1989

[51] Int. Cl.[5] ..... B26B 13/00

[52] U.S. Cl. ..... 30/230; 30/355

[58] Field of Search ..... 30/229, 230, 178, 355

[56] References Cited

U.S. PATENT DOCUMENTS 2,916,822 12/1959 Weidauer et al. ..... 30/230
3,222,783 12/1965 Kolts et al. ..... 30/230

FOREIGN PATENT DOCUMENTS 179023 9/1935 Switzerland ..... 30/230

*Primary Examiner*—Douglas D. Watts
*Attorney, Agent, or Firm*—Thomas C. Saitta

[57] ABSTRACT

A dual-purpose, hand-held scissors for seamstresses and other users which have two unique blades with teeth which will cut a series of proportionately-spaced, single notches (V-shaped indentations) into textile fabrics and other soft, flexible and pliable materials and trim away excess fabric from the article simultaneously. It (1) saves time by performing two essential functions in one operation; (2) simplifies clean-up after sewing because the original method was very messy as when the individual notches were cut, they would scatter everywhere as they fell away from the fabric; and (3) permits more accurately cut notches which are consistent in size and shape to give the article a neater appearance. The shape of the blades is such that upon applying the scissors into the seam allowance on garments and/or toys and crafts, etc., the seam will be trimmed smoothly for a designated distance, then a notch will be cut into the seam allowance and simultaneously trim the excess fabric at that point. By repeatedly applying the scissors until you reach the end of the fabric, the entire seam is both notched and excess fabric trimmed away from the seam allowance in the same operation. Notching and trimming excess fabric or material is necessary in the formation of inner and outer curves. The resulting debris would then consist of only one continuous strip of excess fabric instead of a multitude of small, individual notches in addition to a strip of excess fabric.

4 Claims, 1 Drawing Sheet

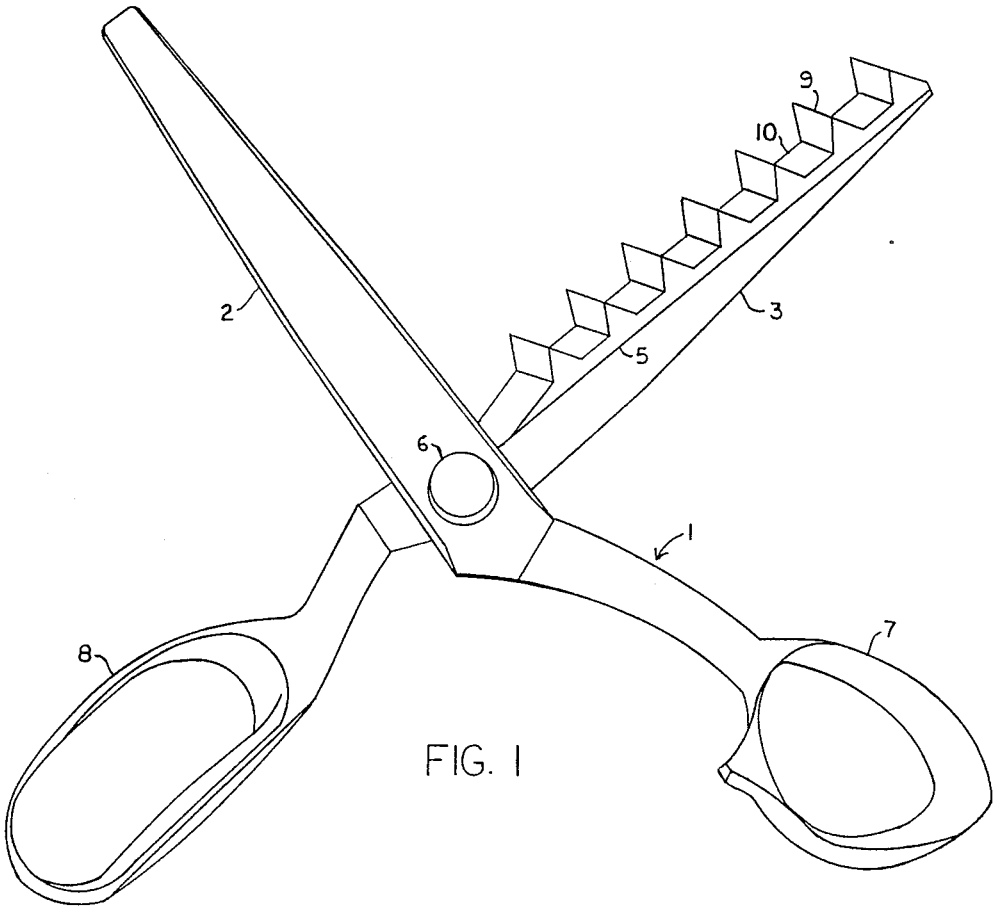
FIG. 1
FIG. 2
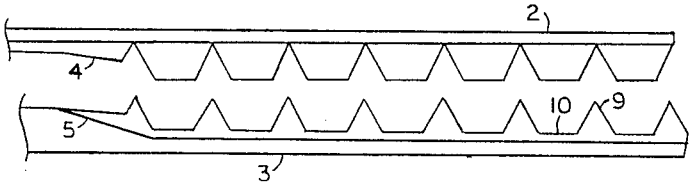
FIG. 3
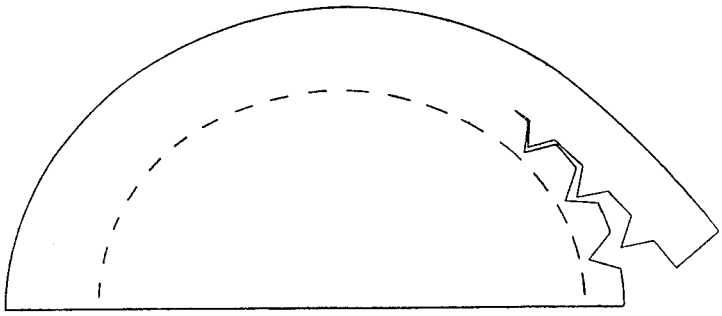

NOTCHING SCISSORS TO NOTCH AND TRIM CURVED SEAMS

BACKGROUND OF THE INVENTION

This invention relates in general to scissors and in particular to scissors with blades for notching and trimming in one operation.

Ordinary scissors are a combination of two blades with handles arranged so that when the two blades are squeezed together, a smooth, continuous cut is made into fabric. There is no other scissors which perform the task as described herein. Until now this procedure had to be physically performed in two separate steps. In sewing certain curved (inner and outer) and/or circular seams to bind two (or more) layers of fabric, or any soft, flexible material, together, special consideration must be given to a procedure which permits the layers of fabric to lay or fit smoothly with the adjacent fabric. In a typical application, this is accomplished by doing two separate operations, using ordinary scissors. After sewing any curved seam in an article, whether it be wearing apparel, stuffed toys, or arts and crafts items, it is necessary to trim away a portion of the customary ⅝ inch seam allowance. This is done by using a pair of ordinary scissors to make a smooth, continuous cut into the seam allowance, thereby eliminating the excess fabric. After this step is performed, you then have to go around this remaining seam allowance and cut a series of individual notches by making two separate angular cuts meeting at a point into the remaining seam allowance, leaving a desired space between them.

Pattern manufacturers instruct seamstresses to trim off excess fabric of seam allowances and "notch" remaining fabric in order to allow curved seams to lie flat and smooth. This is necessary to make a nicer finished article, free from puckers and bulges.

Simplicity Pattern Company instructs you to: "Trim seam; clip inner curves; notch outer curves."

Butterick Pattern Company instructs you to: "Trim enclosed seams into layers. Trim corners; clip inner curves; notch outer curves; press seams open unless otherwise indicated, clipping where necessary so seams will lie flat."

Both operations are time-consuming and the individual cutting of a series of small notches is especially tedious, not to mention being very messy, as the individual notches tend to fly out from the fabric and scatter onto the floor or work surface. Further, the notches will be of varying sizes and shapes. To date there has been no improvement in this procedure and it is still performed by two separate operations.

A further disadvantage is that especially when you are cutting the individual notches, ordinary scissors strain the wrist and the handles of the scissors can leave indentations on the hands of the user if this notching and trimming procedure is lengthy.

Other patents acknowledge the need to have notches at various strategic points in various articles and in assorted materials, such as metal, even for the purpose of merely "marking" a spot where a particular procedure is to be performed. Notches have been used for decades to mark certain points in sewing; but until now, multiple notches had to be cut one at a time, producing messy debris to clean up, along with other annoyances.

In an effort to provide unique ways of cutting notches for various purposes, the following list of patents disclose design features which have been conceived.

| Patent No. | Patentee | Issue Date |
|---|---|---|
| 4,610,086 | Mastroianni | September 9, 1986 |
| 4,597,521 | Wilson | July 1, 1986 |
| 4,589,358 | Goldbock, et al | May 20, 1986 |
| 4,124,937 | Gaughf, Jr. | November 14, 1978 |

Mastroianni discloses a hand tool for sheet metal workers which notches and soft-noses an end of a sheet metal drive in one operation and saves time as compared with use of tin snips to do the same job. This invention recognizes the practicality of being able to do one-operation notching and shaping, which saves time. It is for the purpose of working with sheet metal, however, and does not make a series of notches but only one for the additional function of shaping as a soft nose in the sheet metal being worked.

Wilson discloses a rotary notcher which is used in a continuous strip processing line for metallic strip to cut out side or edge portions of the joined strips in the welded area. This invention recognizes the need for notches in a different material, metal, and the purpose of the notches here is also to smooth out the material being worked with which, in this case, is metal. While it does make a series of notches, it is not a hand-operated tool and does not perform in fabric.

Goldbock, et al, disclose a pocket opening sewing machine including a cutting device for producing two notching cuts at the ends of a pocket opening. This machine is limited to producing only two notches at the ends of pocket openings, which serve in a "marking" capacity for correct placement of machine stitching to complete the sewing process. It is not a hand-held tool; it does not cut a series of consistently spaced notches; and it does not trim away unwanted fabric.

Gaughf, Jr., discloses a hand-operated notch cutting tool that will notch woven fabric, pliable or other thin material. This tool, however, will only cut a single notch at a time and does not cut a series of uniformly-sized notches which are desirably spaced apart. Further, it does not simultaneously trim the excess fabric from the work product.

While the above-listed patents provide for various means with which to produce notches for various purposes and in assorted materials, none of them provides for a means to continuously notch materials at regularly spaced intervals and simultaneously trim away the unwanted material.

SUMMARY OF THE INVENTION

It is the purpose of this invention to provide hand-held scissors that, in one operation, by repeatedly moving the handles of the scissors toward each other, cut a series of uniformly-sized individual notches, which are spaced at desirable and regular intervals, into the seam allowance of fabrics and other soft, flexible and pliable materials and simultaneously trim away the excess material. There is no other way to accomplish this procedure in one operation.

Additional objectives are to provide a method that is faster, more precise, cleaner to use, and that produces finished work of uniform, smooth appearance.

Further, by being able to accomplish the procedure of notching and trimming in one operation in much less time than the former method, it reduces fatigue and strain to the hands and wrists of the user while performing this essential step in sewing.

BRIEF DESCRIPTION OF DRAWINGS

FIG. I is a perspective view of the preferred embodiment of the invention which shows scissors with a means to cut a series of individual notches in textile fabric and other soft, flexible and pliable materials.

FIG. 2 is a plan view of the blades which shows the flanges upon which are mounted the cutting teeth with notching capabilities.

FIG. 3 is a view of a pattern piece of fabric, a portion of which has been notched and trimmed.

DESCRIPTION OF THE PREFERRED EMBODIMENT

To promote a clear understanding and appreciation of the principles and advantages of this invention, the following references will be made to the embodiment illustrated in the drawings, in which like reference numerals refer to like parts, and specific language will be used to describe same.

With reference to FIG. 1, there is illustrated a pair of scissors which are similar in size, shape and general configuration to ordinary household and/or sewing scissors. The departure from previous cutting blades and advantages of the new, improved embodiment will become more readily apparent on examination of the following descriptions. Scissors 1 are comprised of blades 2 and 3, onto each of which is formed a flange, 4 and 5 respectively, and which have a pivotal connection 6, then extend to their outward limits to form handles 7 and 8 thereupon. The handle 7 is manufactured as a projection of blade 3 and the handle 8 is manufactured as a projection of blade 2. The upper blade 2 has sharp cutting teeth which co-act with the cutting teeth of the lower blade 3 to provide a shearing cut when the handles are moved towards each other. It should be noted that the mechanical envelope of the cutting teeth of blade 3 is the complement of the mechanical envelope of the cutting teeth of blade 2, with sufficient inter-tooth spacing to accord the movement. Connection of blades 2 and 3 is pivotal and accomplished by any suitable mechanical means.

A closer examination of the cutting teeth 9 is provided in FIG. 2. Blade 3 includes a flange 5, onto which is mounted singular, triangularly-shaped at approximately forty-five degree angles, teeth 9 which are separated a desired distance apart by a smooth cutting edge. The spaces 10 between the teeth 9 are approximately one-quarter inch in length at which location the fabric shall be cut on a smooth plane, parallel to the seam. The proportional spacing of the teeth of the blades permits individual notches to be cut while the remaining, excess fabric is eliminated. The length of the blades provides for a series of such uniformly spaced notches.

As with ordinary scissors, the user merely grasps the handles 7 and 8 and squeezes them together to notch and cut simultaneously at the desired location, i.e., in the illustrated application (FIG. 3) on an outward curve. After the first completed notch and cut operation, the scissors handles are opened and again squeezed together whereby another notch and cut series is effected. The notching and cutting is continued in like fashion until the entire desired length has been notched and trimmed simultaneously, providing a very desirable and long-needed utility purpose.

FIG. 3 conceives the possibility of the appearance of a pattern piece of fabric after the notching scissors have notched a portion of the seam and the remaining excess of fabric has been trimmed away, all in one, neat operation. However, it should be recognized that notches will be of consistent size when notching scissors are used.

It should be apparent to a person skilled in the art that this new embodiment quickly, neatly, and with greater uniformity, performs two operations at the same time.

Although the invention has been illustrated and described in detail in the drawings and the above description, the same is to be considered merely as illustrative and not restrictive in character. This invention can be utilized in any sewing, notching, trimming, and shaping operation on textile fabric or any other soft, flexible and pliable material used in the fabrication of clothing, dolls, stuffed animals and toys, and any arts and crafts projects which might need special handling for inward and outward curves. Additional uses for this invention will become apparent to a person skilled in the art upon their inspection of these specifications. It should be understood that no limitation of the scope of the preferred embodiment is intended. Alterations, modifications to the illustrated invention, and any further applications of the principles of the preferred embodiment shall also be protected.

What I claim is:

1. Hand operated notch cutting scissors for use in cutting textile fabric, comprising pivotally connected first and second blades, said first blade having a different configuration from said second blade, said first blade having a series of triangular cutting teeth spaced by a linear cutting edge at the base of each of said teeth, said second blade having a series of trapezoidal cutting teeth forming a cutting edge complementary to the cutting teeth and linear cutting edge of said first blade, whereby the cutting edge of said second blade is brought into continuous progressive contact with the cutting teeth and linear cutting edge of said first blade to perform a simultaneous notching and trimming action.

2. The scissors of claim 1, where said cutting teeth and said linear cutting edge of said first blade extend from a first flange on said first blade, and said cutting edge of said second blade extends from a second flange on said second blade.

3. The scissors of claim 1, where said triangular cutting teeth are approximately one quarter inch in height.

4. The scissors of claim 1, where said triangular cutting teeth are spaced approximately one quarter inch apart at the base of each of said teeth.

* * * * *